US006219636B1

(12) United States Patent
Ihara

(10) Patent No.: US 6,219,636 B1
(45) Date of Patent: Apr. 17, 2001

(54) AUDIO PITCH CODING METHOD, APPARATUS, AND PROGRAM STORAGE DEVICE CALCULATING VOICING AND PITCH OF SUBFRAMES OF A FRAME

(75) Inventor: Takeki Ihara, Tsurugashima (JP)

(73) Assignee: Pioneer Electronics Corporation, Tokyo (JP)

( * ) Notice: Subject to any disclaimer, the term of this patent is extended or adjusted under 35 U.S.C. 154(b) by 0 days.

(21) Appl. No.: 09/257,382

(22) Filed: Feb. 25, 1999

(30) Foreign Application Priority Data

Feb. 26, 1998 (JP) ..... 10-045933

(51) Int. Cl.[7] ..... G10L 11/04
(52) U.S. Cl. ..... 704/207
(58) Field of Search ..... 704/207, 208, 704/214

(56) References Cited

U.S. PATENT DOCUMENTS 4,989,250 * 1/1991 Fujimoto et al. ..... 704/207
5,091,946 * 2/1992 Ozawa ..... 704/208
5,495,555 * 2/1996 Swaminathan ..... 704/207
5,657,418 * 8/1997 Gerson et al. ..... 704/207
5,732,389 * 3/1998 Kroon et al. ..... 704/223

* cited by examiner

*Primary Examiner*—David Hudspeth
*Assistant Examiner*—Donald L. Storm
(74) *Attorney, Agent, or Firm*—Finnegan, Henderson, Farabow, Garrett and Dunner, L.L.P.

(57) ABSTRACT

A pitch coding method is provided for calculating and coding the pitch of each sub frame of a speech input that is divided into a plurality of frames which are separated into a plurality of sub frames. The method calculates the pitch of each of the sub frames included in one or more of the frames, and determines whether or not the speech input is a voiced sound accompanying the vibration of a vocal chord. If it is determined that a head sub frame of a first speech input is the voiced sound, the pitch of the head sub frame is coded. Otherwise, if a subsequent sub frame is determined to be the voiced sound, a standard pitch value is selected and coded for the head sub frame. The method also determines whether a frame preceding the subsequent sub frame is judged to be the voiced sound, and if so the difference between the pitch of the preceding frame and the pitch of the subsequent frames is calculated and coded. If the preceding frame is not the voiced sound, the difference between the selected standard pitch and the subsequent frame's pitch is calculated and coded.

6 Claims, 3 Drawing Sheets

AUDIO PITCH CODING METHOD, APPARATUS, AND PROGRAM STORAGE DEVICE CALCULATING VOICING AND PITCH OF SUBFRAMES OF A FRAME

BACKGROUND OF THE INVENTION

1. Field of the Invention

The present invention generally relates to an audio coding technique, and more particularly to a method of and an apparatus for coding audio pitch information and a program storage device readable by the audio pitch coding apparatus on which the audio pitch coding program is recorded.

2. Description of the Related Art

The pitch based on a long cycle correlation of an audio signal due to a cyclic characteristic of a vibration of a human vocal chord is extracted and coded in order to code the audio signal at a high efficiency. Namely, since waveforms similar to each other are repeated at a predetermined cycle determined by this pitch in the audio signal, it is possible to code the audio signal at a high efficiency by combining the audio coding technique with a short time period prediction based on a proximity correlation. In the CELP (Code Excited Linear Prediction) as a representative audio coding method, such a construction is employed that the content of an adaptive code book is used as a driving source of a past synthesis filter, is once reproduced, and the pitch is determined so as to minimize a perceptual weighted error power with the input signal. Thus, the pitch extraction is an indispensable element of the technique.

By the way, in the audio coding method such as the CELP, the input speech is divided into a plurality of frames, the coding process is performed for each of the frames, and each of the frames is further divided into a plurality of sub frames. The sub frame is a basic unit for the processes such as a vector quantization process and the like. Then, the above mentioned pitch extraction is performed such that respective one of the pitches is calculated for each of the sub frames, and this calculated pitch is code-processed within a range of one or a plurality of frames. Here, upon coding the calculated pitch, although it is possible to code the value of the calculated pitch itself with respect to each of the sub frames in one frame, it is effective to code the value of the calculated pitch itself with respect to only one sub frame at the head in each frame and to code the difference between the calculated pitch and that of the previous sub frame with respect to the subsequent sub frames in the frame, so as to reduce the data amount of coding.

However, the audio signal can be categorized into: a voiced sound, in which an input speech accompanying the vibration of a vocal chord exists; an unvoiced sound, in which only an input speech not accompanying the vibration of a vocal chord exists; and a silence in which an input speech does not exist. The audio pitch has a meaning with respect to the portion of the voiced sound. Thus, after judging into which condition the audio signal is categorized, the pitch coding process is not performed if the sub frame, which is the minimum unit for the process, is judged to be the unvoiced sound or the silence (i.e., other than the voiced sound). Accordingly, if the head of the sub frames in one frame is not judged to be the voiced sound, since the standard value for the difference to be obtained for the subsequent sub frames is not determined, the pitch coding process is not performed as for one whole frame. In this case, the reproduction signal is not outputted from the adaptive code book in the CELP or the like.

Therefore, in the above mentioned audio coding method, it is difficult to reduce the data amount for coding and to realize a fine pitch coding process with a high fidelity for the input speech. Especially, in case that one frame is rather long or in case that the number of sub frames in one frame is large, since such a possibility increases that the sub frame, which is not judged to be the voiced sound, is included in the frame, the quality of the audio coding process may be certainly degraded.

SUMMARY OF THE INVENTION

It is therefore an object of the present invention to provide a coding method, a coding apparatus and a program storage device readable by the coding apparatus on which a coding program is recorded, which can code the pitch of an input speech with a high fidelity even in case that a sub frame which is not judged to be the voiced sound is included in one frame, without drastically increasing the data amount for coding.

The above object of the present invention can be achieved by a pitch coding method of calculating and coding a pitch of an input speech, which is divided into a plurality of frames which is further divided into a plurality of sub frames, for each of the sub frames. The pitch coding method is provided with: a calculating process of calculating a pitch of each of the sub frames included in one or a plurality of the frames; a judging process of judging whether or not the input speech included in each of the sub frames is a voiced sound accompanying a vibration of a vocal chord; a first coding process of (i) coding, if a head sub frame of the sub frames which includes a first input speech is judged to be the voiced sound, the calculated pitch of the head sub frame, and (ii) selecting and coding, if the head sub frame is not judged to be the voiced sound and a subsequent sub frame of the sub frames which is subsequent to the head sub frame is judged to be the voiced sound, one of standard pitch values set in advance for the head sub frame; and a second coding process of (i) calculating and coding, if a preceding sub frame of the sub frames which is preceding to the subsequent sub frame judged to be the voiced sound is judged to be the voiced sound, a difference between the calculated pitch of the preceding sub frame and the calculated pitch of the subsequent sub frame, and (ii) calculating and coding, if the preceding sub frame is not judged to be the voiced sound, a difference between the selected standard value and the calculated pitch of the subsequent sub frame.

According to the pitch coding method of the present invention, by the calculating process, a pitch of each of the sub frames included in one or a plurality of the frames is calculated. Then, by the judging process, it is judged whether or not the input speech included in each of the sub frames is a voiced sound accompanying a vibration of a vocal chord. Then, by the first coding process, the coding process with respect to the head sub frame is performed. Namely, if the head sub frame of the sub frames is judged to be the voiced sound, the calculated pitch of the head sub frame is coded. Alternatively, if the head sub frame is not judged to be the voiced sound and the subsequent sub frame is judged to be the voiced sound, one of standard pitch values set in advance for the head sub frame is selected and coded. Further, by the second coding process, the coding process with respect to the subsequent sub frame is performed. Namely, if the preceding sub frame is judged to be the voiced sound, the difference between the calculated pitch of the preceding sub frame and the calculated pitch of the subsequent sub frame is calculated and coded. Alternatively, if the preceding sub frame is not judged to be the voiced sound, the difference between the selected standard value and the calculated pitch of the subsequent sub frame is calculated and coded.

Therefore, since not only the calculated pitch itself but also the difference of the calculated pitch are coded by using the predetermined standard value in accordance with the judgement results for the voiced sound, even in case that the judgment results for the voiced sounds change within a plurality of sub frames in one frame, to which the pitch coding process is applied, it is possible to code the pitch by using the difference with a high fidelity, so that it is possible to code the pitch information while keeping its quality high and without drastically increasing the data amount for coding.

In one aspect of the pitch coding method of the present invention, in the first and second coding processes, the pitch or the difference with respect to the sub frame judged to be the voiced sound is coded by obtaining a delay, which minimizes a perceptual weighted error power of (i) a reproduction signal of an adaptive code book which holds a past excitation signal within a predetermined time interval and which is updated sub frame by sub frame and (ii) the input signal.

According to this aspect, in the first and second coding processes, if the sub frame as the object for coding is the voiced sound, the pitch or the difference is coded by obtaining the delay, which minimizes the perceptual weighted error power of the reproduction signal of the adaptive code book and the input signal, when reproducing the reproduction signal.

Accordingly, since the process of coding the pitch or the difference is performed by using the adaptive code book so as to minimize the perceptual weighted error power, it is possible to perform the coding process suitable for reducing the quantization noise, so that it is possible to code the pitch information while keeping its quality high and without drastically increasing the data amount for coding.

The above object of the present invention can be also achieved by a pitch coding apparatus for calculating and coding a pitch of an input speech, which is divided into a plurality of frames which is further divided into a plurality of sub frames, for each of the sub frames. The pitch coding apparatus is provided with: a calculating device for calculating a pitch of each of the sub frames included in one or a plurality of the frames; a judging device for judging whether or not the input speech included in each of the sub frames is a voiced sound accompanying a vibration of a vocal chord; a first coding device for (i) coding, if a head sub frame of the sub frames which includes a first input speech is judged to be the voiced sound, the calculated pitch of the head sub frame, and (ii) selecting and coding, if the head sub frame is not judged to be the voiced sound and a subsequent sub frame of the sub frames which is subsequent to the head sub frame is judged to be the voiced sound, one of standard pitch values set in advance for the head sub frame; and a second coding device for (i) calculating and coding, if a preceding sub frame of the sub frames which is preceding to the subsequent sub frame judged to be the voiced sound is judged to be the voiced sound, a difference between the calculated pitch of the preceding sub frame and the calculated pitch of the subsequent sub frame, and (ii) calculating and coding, if the preceding sub frame is not judged to be the voiced sound, a difference between the selected standard value and the calculated pitch of the subsequent sub frame.

According to the pitch coding apparatus of the present invention, by the calculating device, a pitch of each of the sub frames included in one or a plurality of the frames is calculated. Then, by the judging device, it is judged whether or not the input speech included in each of the sub frames is a voiced sound accompanying a vibration of a vocal chord. Then, by the first coding device, the coding process with respect to the head sub frame is performed. Namely, if the head sub frame of the sub frames is judged to be the voiced sound, the calculated pitch of the head sub frame is coded. Alternatively, if the head sub frame is not judged to be the voiced sound and the subsequent sub frame is judged to be the voiced sound, one of standard pitch values set in advance for the head sub frame is selected and coded. Further, by the second coding device, the coding process with respect to the subsequent sub frame is performed. Namely, if the preceding sub frame is judged to be the voiced sound, the difference between the calculated pitch of the preceding sub frame and the calculated pitch of the subsequent sub frame is calculated and coded. Alternatively, if the preceding sub frame is not judged to be the voiced sound, the difference between the selected standard value and the calculated pitch of the subsequent sub frame is calculated and coded.

Therefore, since not only the calculated pitch itself but also the difference of the calculated pitch are coded by using the predetermined standard value in accordance with the judgement results for the voiced sound, even in case that the judgment results for the voiced sounds change within a plurality of sub frames in one frame, to which the pitch coding process is applied, it is possible to code the pitch by using the difference with a high fidelity, so that it is possible to code the pitch information while keeping its quality high and without drastically increasing the data amount for coding.

In one aspect of the pitch coding apparatus of the present invention, in the first and second coding devices, the pitch or the difference with respect to the sub frame judged to be the voiced sound is coded by obtaining a delay, which minimizes a perceptual weighted error power of (i) a reproduction signal of an adaptive code book which holds a past excitation signal within a predetermined time interval and which is updated sub frame by sub frame and (ii) the input signal.

According to this aspect, in the first and second coding devices, if the sub frame as the object for coding is the voiced sound, the pitch or the difference is coded by obtaining the delay, which minimizes the perceptual weighted error power of the reproduction signal of the adaptive code book and the input signal, when reproducing the reproduction signal.

Accordingly, since the process of coding the pitch or the difference is performed by using the adaptive code book so as to minimize the perceptual weighted error power, it is possible to perform the coding process suitable for reducing the quantization noise, so that it is possible to code the pitch information while keeping its quality high and without drastically increasing the data amount for coding.

The above object of the present invention can be also achieved by a program storage device readable by a computer for coding a pitch of an input speech, tangibly embodying a program of instructions executable by the computer to perform method processes for calculating and coding the pitch of the input speech, which is divided into a plurality of frames which is further divided into a plurality of sub frames, for each of the sub frames. The method processes include: a calculating process of calculating a pitch of each of the sub frames included in one or a plurality of the frames; a judging process of judging whether or not the input speech included in each of the sub frames is a voiced sound accompanying a vibration of a vocal chord; a first coding process of (i) coding, if a head sub frame of the sub frames which includes a first input speech is judged to be the voiced sound, the calculated pitch of the head sub frame, and (ii) selecting and coding, if the head sub frame is not judged to be the voiced sound and a subsequent sub frame of the sub frames which is subsequent to the head sub frame is judged to be the voiced sound, one of standard pitch values set in advance for the head sub frame; and a second coding process of (i) calculating and coding, if a preceding sub frame of the sub frames which is preceding to the subsequent sub frame judged to be the voiced sound is judged to be the voiced sound, a difference between the calculated pitch of the preceding sub frame and the calculated pitch of the subsequent sub frame, and (ii) calculating and coding, if the preceding sub frame is not judged to be the voiced sound, a difference between the selected standard value and the calculated pitch of the subsequent sub frame.

Accordingly, the above described pitch coding method of the present invention can be performed as the program stored in the program storage device is installed to the computer for coding the pitch and the computer executes the installed program.

In one aspect of the program storage device of the present invention, in the first and second coding processes, the pitch or the difference with respect to the sub frame judged to be the voiced sound is coded by obtaining a delay, which minimizes a perceptual weighted error power of (i) a reproduction signal of an adaptive code book which holds a past excitation signal within a predetermined time interval and which is updated sub frame by sub frame and (ii) the input signal.

Accordingly, the above described one aspect of the pitch coding method of the present invention can be performed as the program stored in this one aspect of the program storage device is installed to the computer for coding the pitch and the computer executes the installed program.

The nature, utility, and further features of this invention will be more clearly apparent from the following detailed description with respect to preferred embodiments of the invention when read in conjunction with the accompanying drawings briefly described below.

DETAILED DESCRIPTION OF THE PREFERRED EMBODIMENT

Referring to the accompanying drawings, an embodiment of the present invention will be now explained.

Figure 1A:
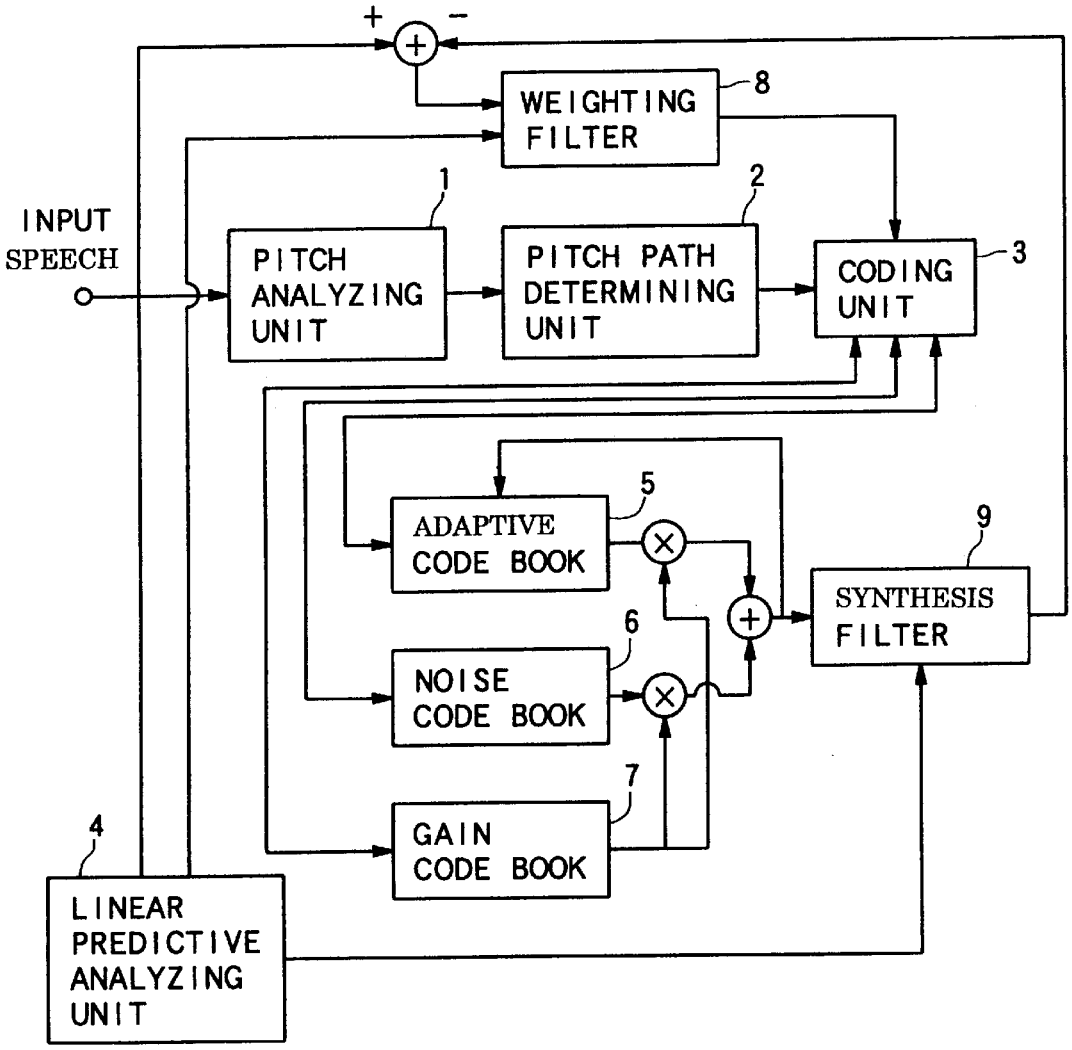
FIG. 1A is a block diagram showing a whole structure of a CELP coding apparatus as an embodiment of the present invention.

In FIG. 1A, a CELP coding apparatus is provided with a pitch analyzing 1, a pitch path determining unit 2, a coding unit 3, a linear predictive analyzing unit 4, an adaptive code book 5, a noise code book 6, a gain code book 7, an audible weighting filter 8 and a synthesis filter 9.

An input speech is divided into a plurality of frames. Each of the frames is further divided into a plurality of sub frames. Various parameters are extracted and coded for each of the sub frames or for each of the frames. At first, the input speech is inputted to the linear predictive analyzing unit 4 for each of the sub frames, and the process for obtaining the predictive value by use of a proximity correlation between the sample values is performed.

The coding process of a linear predictive residual in the CELP coding method is performed by use of the vector quantization using three kinds of code books such that an optimum quantization vector (i.e., an index of each code book) is determined for each of the sub frames, and that the index of each code book at that time is set as the coded data to be transferred. The adaptive code book 5 reproduces the signal once by use of a past driving source to be inputted to a synthesis filter 9, and performs a pitch prediction so as to minimize the perceptual weighted error power with the input signal. The noise code book 6 approximates the pitch predictive residual signal by using the noise signal having the Gaussian probability density as the sound source. The gain code book 7 determines an optimum gain under a condition that the optimum index is determined in the adaptive code book 5 and the noise code book 6.

The input speech is also inputted to the pitch analyzing unit 1 for each of the sub frames. Then, after the pitch path information is obtained by means of an open loop searching method through the pitch path determining unit 2, the index of the above mentioned adaptive code book is determined in the coding unit 3. Then, the process of coding the pitch based on the long cycle correlation of the audio signal by means of the closed loop searching method is performed. This pitch coding process will be described later in detail.

The synthesis filter 9 determines the coefficient of the filter on the basis of the predictive result in the linear predictive analyzing unit 7. The signal of the index obtained by each code book is inputted to the synthesis filter 9, and the synthesis filter 9 outputs it as the reproduced audio. Then, the error power of the reproduction signal, which is outputted from the synthesis filter 9, with the input speech is obtained. Then, the obtained error power is passed through the audible weighted filter 8 for reducing the quantization noise by using the masking phenomenon of the human audibility. Then, the coding process is performed so as to minimize the error power in the coding unit 3.

Figure 1B:
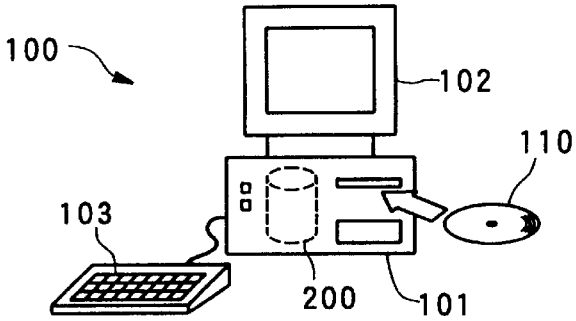
FIG. 1B is an appearance view of a computer system in which the coding apparatus of FIG. 1A is constructed.

FIG. 1B shows an appearance of the coding apparatus of FIG. 1A.

In FIG. 1B, the coding apparatus is realized by a computer system 100 provided with: a main unit 101 including a CPU (Central Processing Unit), a RAM (Random Access Memory) storing code books 200, a reading device etc.,; a displaying unit 102 for displaying various information; and an inputting device 103 for inputting various command, data and so on. A record medium 110 such as a CD-ROM, a DVD-ROM, a floppy disc or the like, is loaded to the main unit 101 as one example of a program storage device readable by the computer system 100, so that the computer system 100 functions in accordance with the program stored in the record medium 110 as the coding apparatus.

Next, the pitch coding process by means of the closed loop method is explained with reference to the flow chart of FIG. 2. In the pitch coding process shown in FIG. 2, after the pitch path information obtained by the open loop searching method performed by the pitch analyzing unit 1 and the pitch path determining unit 2 is inputted, the pitch for each of the sub frames is determined on the basis of the closed loop searching method.

Here, the outline of the generation of the pitch path information by means of the open loop searching method is explained. In the present embodiment, one frame is constituted by four sub frames, and each process is performed within one frame.

At first, M pitch candidates with respect to each of the sub frames within one frame are obtained. More concretely, the LPC (Linear Predictive Coding) is performed for each of the sub frames, and, after a hamming window is multiplied onto the predictive residual thereof, the M pitch candidates are determined in the order of the larger self correlation function, within a predetermined range which can be the pitch in consideration with its corresponding sampling number or its interpolation.

Then, in each of the sub frames, the sub frame whose self correlation function is the largest is set as the starting point of the pitch path, and the pitch which maximizes the self correlation is determined in case of giving a delay, within the range expressed by the difference at coding each of the M pitch candidates, to the input signal. This pitch determination is repeated as for each of the sub frames in the forward direction and the backward direction.

As a result, four pitch arrangements determined by the above mentioned method from the head sub frame to the last sub frame i.e., M kinds of the pitch paths are generated. From those M pitch paths, one optimum pitch path as one whole frame e.g., one path which minimizes the sum of the distortions with respect to four sub frames, is selected as the pitch information to be inputted to the coding unit 3.

Figure 2:
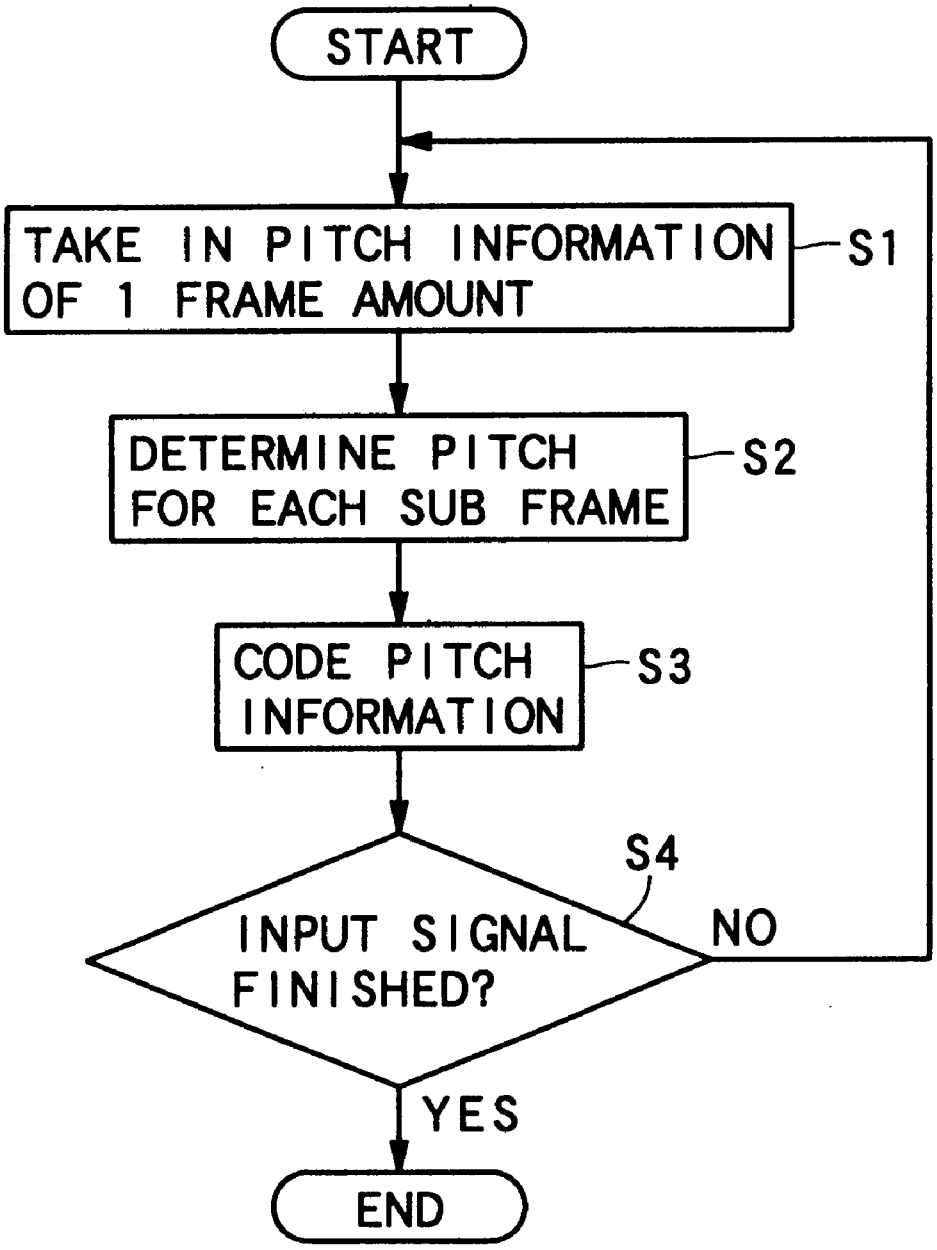
FIG. 2 is a flow chart showing a pitch coding process by means of a closed loop searching method in the present embodiment.

In FIG. 2, the pitch path information, obtained in the above mentioned manner, of one frame amount is taken in so as to perform the pitch coding process based on the closed loop searching method (step S1). Then, the pitch is determined sequentially for each of the sub frames (step S2). More concretely, after a plurality of pitch candidates are selected with respect to the pitch value of the pitch path information for each of the sub frames as the center, one pitch whose self correlation is the maximum is selected from among those selected pitch candidates. At this time, a plurality of pitch candidates may be preliminarily selected by a simple calculation from among those selected pitch candidates, and one pitch may be further selected from among the preliminarily selected pitch candidates.

Next, the process of coding the pitch information is performed according to the process described later in detail (step S3).

Incidentally, the pitch coding process is performed on the basis of the judgment result of judging whether the input speech is the voice existing sound or not for each of the sub frames. More concretely, since the pitch of the input speech is the fundamental cycle (fundamental period) of the vibration of the vocal chord, the pitch cannot be essentially extracted if the audio is the unvoiced sound which does not accompany the vibration of the vocal chord. Thus, as for the sub frame which is not judged to be the voice existing sound, the process of coding the pitch is not performed.

Finally, the existence of the input signal to be processed is judged (step S4). If the process for all of the input signals is finished since the new input signal does not exist (step S4: NO), the coding process is ended. If there exists the input signal to be processed (step S4: NO), the operation flow returns to the step S1.

Figure 3:
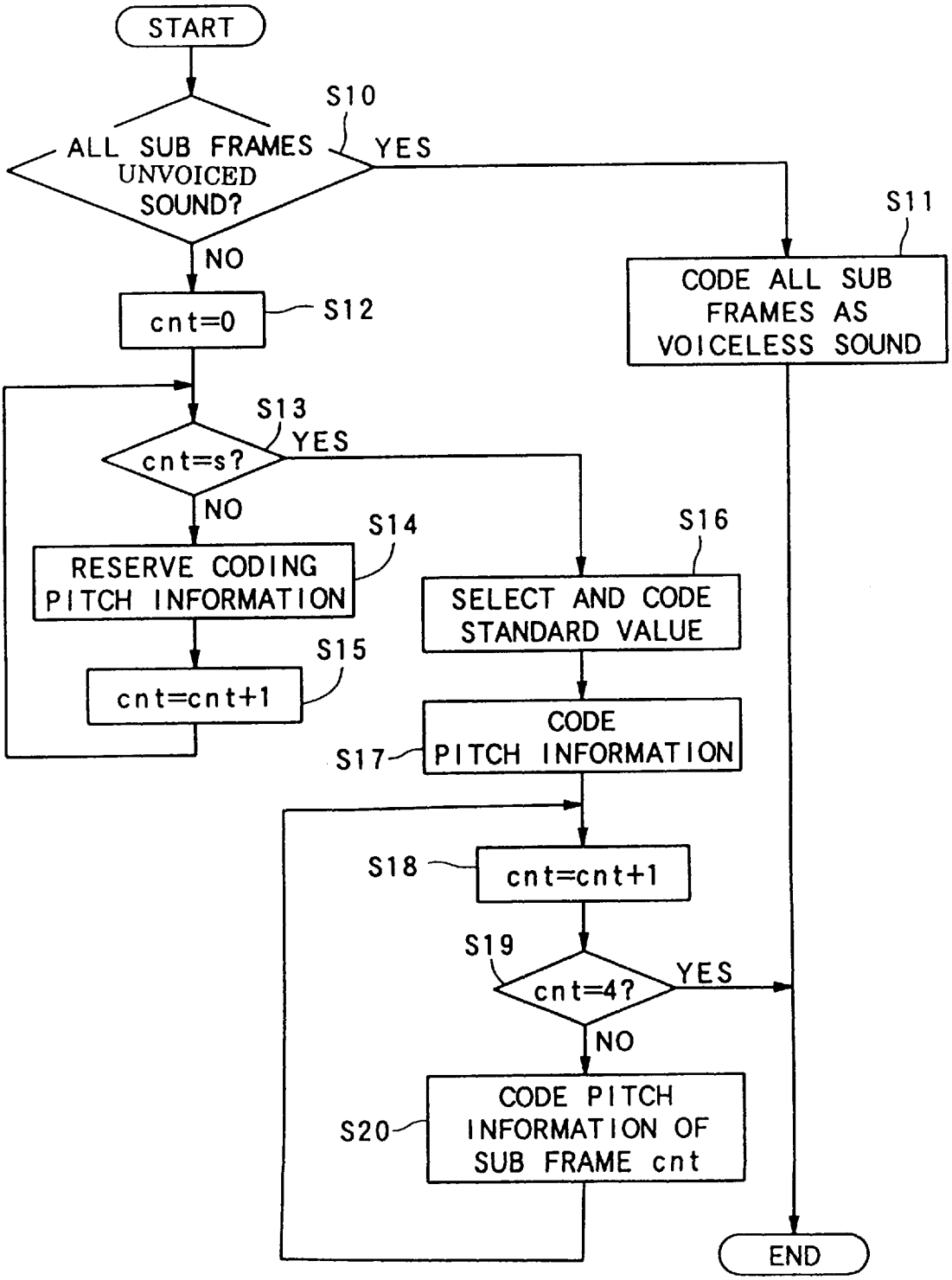
FIG. 3 is a flow chart showing the process of coding the pitch information in detail in the present embodiment.

Next, the above mentioned process of coding the pitch information corresponding to the step S3 of FIG. 2 is explained in detail with reference to the flow chart of FIG. 3.

At first, when analyzing the pitch, the process of judging whether it is the voiced sound or not is performed. Then, the operation flow branches for all of the sub frames in accordance with the judgment results respectively within one frame (step S10). If all of the sub frames in one frame are judged to be the unvoiced sounds (step S10: YES), the coding process is performed by use of a pattern set for the unvoiced sound for all of the sub frames (step S11), and the process is ended.

On the other hand, if there is any sub frame which is judged to be the voiced sound (step S10: NO), the counter cnt for processing the sub frame is zero-cleared (step S12). This counter cnt is to judge whether or not it reaches the sub frame which is firstly judged as the voiced sound within one frame. The value of this sub frame initially judged as the voiced sound is set in advance as s, and the comparison between the counter cnt and this value s is performed (step S13).

Then, if the counter cnt does not reach this value s (step S13: NO), the pitch corresponding to the sub frame is not coded, and coding the pitch information is once reserved (step S14). Then, after incrementing the counter cnt (step S15), the operation flow returns to the process for a next sub frame (step S13).

On the other hand, if the counter cnt reaches the value s (step S13: YES), as for the head sub frame, one pitch standard value, which is the closest to the pitch of the $s^{th}$ sub frame among a plurality of pitch standard values set in advance (the standard values each having the pitch information although the output of the adaptive code book 5 does not exist for it), is selected and is coded as the pitch information (step S16).

Here, the standard value of the pitch is explained. Normally, when coding the pitch information of a plurality of sub frames within one frame, the coding process may be performed on the basis of the pitch value itself which is determined at the step S2 of FIG. 2. However, in case that the number of the sub frames within one frame is large or the like, since the data amount assigned as the pitch information is drastically increased, it is not suitable for performing the audio coding process at the high efficiency. Therefore, it is effective for the reduction of the data amount to code the head sub frame on the basis of the pitch value, to obtain the difference in the pitch between each of the subsequent sub frames and its one preceding sub frame and to code the obtained difference respectively.

If the sub frame to be processed is always the voiced sound, there is no problem to perform the coding process. As for the sub frame which is the unvoiced sound, the pitch is not coded and a a pattern indicating that it is the unvoiced sound is set as the pitch information. Thus, as for the $s^{th}$ sub frame which becomes the first voiced sound, since the pitch of the $(s-1)^{th}$ sub frame cannot be extracted, the above mentioned difference cannot be obtained.

Therefore, if the head sub frame is the unvoiced sound, the "standard value" is held, and the coding process is performed while the $2^{nd}$ to $(s-1)^{th}$ sub frames are concluded as "the difference 0 and no output" (step S17).

Then, in order to process the next sub frame, the counter cnt is incremented (step S18), and it is judged whether or not the counter cnt reaches "4" (step S19). If cnt=4 (step S19: YES), since the pitch coding process as for four sub frames within one frame is finished, the process is ended.

On the other hand, if cnt≠4 (step S19: NO), in case that the sub frame as the object is the voiced sound, the above mentioned difference is obtained and coded. Alternatively, in case that the sub frame as the object is the unvoiced sound, the coding process is performed as "the difference 0 and no output" (step S20). Then, the operation flow returns to the process for the next sub frame indicated by the counter cnt (step S18).

By performing the above mentioned processes, it is possible to appropriately code the pitch information of the input speech with respect to one or a plurality of sub frames including both of the sub frames of the voiced sound and the unvoiced sound. Especially, even in such a case that, after the sub frames of the unvoiced sounds are continues at the head portion, the $s^{th}$ sub frame is firstly judged to be the voiced sound, the coping process can be performed by using the difference between the pitch of each of the subsequent sub frames and the predetermined standard value.

The above described pitch coding method of the present embodiment can be stored as a computer software program in the record medium 110 such as a CD-ROM, a DVD-ROM, a floppy disc or the like (in FIG. 1B) which is readable by the computer system 100. Then, by installing and executing this program in the computer system 100, the method of and the apparatus for coding the pitch information of the present embodiment can be realized.

The invention may be embodied in other specific forms without departing from the spirit or essential characteristics thereof. The present embodiments are therefore to be considered in all respects as illustrative and not restrictive, the scope of the invention being indicated by the appended claims rather than by the foregoing description and all changes which come within the meaning and range of equivalency of the claims are therefore intended to be embraced therein.

The entire disclosure of Japanese Patent Application No. 10-045933 filed on Feb. 26, 1998 including the specification, claims, drawings and summary is incorporated herein by reference in its entirety.

What is claimed is:

1. A pitch coding method of calculating and coding a pitch of an input speech, which is divided into a plurality of frames which is further divided into a plurality of sub frames, for each of the sub frames, comprising:

a calculating process of calculating a pitch of each of the sub frames included in one or a plurality of the frames;

a judging process of judging whether or not the input speech included in each of the sub frames is a voiced sound accompanying a vibration of a vocal chord;

a first coding process of (i) coding, if a head sub frame of the sub frames which includes a first input speech is judged to be the voiced sound, the calculated pitch of the head sub frame, and (ii) selecting and coding, if the head sub frame is not judged to be the voiced sound and a subsequent sub frame of the sub frames which is subsequent to the head sub frame is judged to be the voiced sound, one of standard pitch values set in advance for the head sub frame; and a second coding process of (i) calculating and coding, if a preceding sub frame of the sub frames which is preceding to the subsequent sub frame judged to be the voiced sound is judged to be the voiced sound, a difference between the calculated pitch of the preceding sub frame and the calculated pitch of the subsequent sub frame, and (ii) calculating and coding, if the preceding sub frame is not judged to be the voiced sound, a difference between the selected standard value and the calculated pitch of the subsequent sub frame.

2. A pitch coding method according to claim 1, wherein in the first and second coding processes, the pitch or the difference with respect to the sub frame judged to be the voiced sound is coded by obtaining a delay, which minimizes a perceptual weighted error power of (i) a reproduction signal of an adaptive code book which holds a past excitation signal within a predetermined time interval and which is updated sub frame by sub frame and (ii) the input signal.

3. A pitch coding apparatus for calculating and coding a pitch of an input speech, which is divided into a plurality of frames which is further divided into a plurality of sub frames, for each of the sub frames, comprising:

a calculating device for calculating a pitch of each of the sub frames included in one or a plurality of the frames;

a judging device for judging whether or not the input speech included in each of the sub frames is a voiced sound accompanying a vibration of a vocal chord;

a first coding device for (i) coding, if a head sub frame of the sub frames which includes a first input speech is judged to be the voiced sound, the calculated pitch of the head sub frame, and (ii) selecting and coding, if the head sub frame is not judged to be the voiced sound and a subsequent sub frame of the sub frames which is subsequent to the head sub frame is judged to be the voiced sound, one of standard pitch values set in advance for the head sub frame; and a second coding device for (i) calculating and coding, if a preceding sub frame of the sub frames which is preceding to the subsequent sub frame judged to be the voiced sound is judged to be the voiced sound, a difference between the calculated pitch of the preceding sub frame and the calculated pitch of the subsequent sub frame, and (ii) calculating and coding, if the preceding sub frame is not judged to be the voiced sound, a difference between the selected standard value and the calculated pitch of the subsequent sub frame.

4. A pitch coding apparatus according to claim 3, wherein in the first and second coding devices, the pitch or the difference with respect to the sub frame judged to be the voiced sound is coded by obtaining a delay, which minimizes a perceptual weighted error power of (i) a reproduction signal of an adaptive code book which holds a past excitation signal within a predetermined time interval and which is updated sub frame by sub frame and (ii) the input signal.

5. A program storage device readable by a computer for coding a pitch of an input speech, tangibly embodying a program of instructions executable by the computer to perform method processes for calculating and coding the pitch of the input speech, which is divided into a plurality of frames which is further divided into a plurality of sub frames, for each of the sub frames, the method processes comprise:

a calculating process of calculating a pitch of each of the sub frames included in one or a plurality of the frames;

a judging process of judging whether or not the input speech included in each of the sub frames is a voiced sound accompanying a vibration of a vocal chord;

a first coding process of (i) coding, if a head sub frame of the sub frames which includes a first input speech is judged to be the voiced sound, the calculated pitch of the head sub frame, and (ii) selecting and coding, if the head sub frame is not judged to be the voiced sound and a subsequent sub frame of the sub frames which is subsequent to the head sub frame is judged to be the voiced sound, one of standard pitch values set in advance for the head sub frame; and a second coding process of (i) calculating and coding, if a preceding sub frame of the sub frames which is preceding to the subsequent sub frame judged to be the voiced sound is judged to be the voiced sound, a difference between the calculated pitch of the preceding sub frame and the calculated pitch of the subsequent sub frame, and (ii) calculating and coding, if the preceding sub frame is not judged to be the voiced sound, a difference between the selected standard value and the calculated pitch of the subsequent sub frame.

6. A program storage device according to claim 5, wherein in the first and second coding processes, the pitch or the difference with respect to the sub frame judged to be the voiced sound is coded by obtaining a delay, which minimizes a perceptual weighted error power of (i) a reproduction signal of an adaptive code book which holds a past excitation signal within a predetermined time interval and which is updated sub frame by sub frame and (ii) the input signal.

* * * * *

UNITED STATES PATENT AND TRADEMARK OFFICE

CERTIFICATE OF CORRECTION

PATENT NO. : 6,219,636 B1
DATED : April 17, 2001
INVENTOR(S) : Ihara

It is certified that error appears in the above-identified patent and that said Letters Patent is hereby corrected as shown below:

Column 9,
Line 42, after "one or" insert, -- more of --.

Column 10,
Line 12, after "one or" insert, -- more of --.
Line 53, after "one or" insert, -- more of --.

Signed and Sealed this

Sixth Day of November, 2001

*Attest:*

Nicholas P. Godici

*Attesting Officer*

NICHOLAS P. GODICI
*Acting Director of the United States Patent and Trademark Office*